US007610696B2

(12) United States Patent
Davis

(10) Patent No.: US 7,610,696 B2
(45) Date of Patent: Nov. 3, 2009

(54) ADJUSTABLE FIT INSOLE SYSTEM FOR SHOES

(75) Inventor: Russell L. Davis, Wynne, AR (US)

(73) Assignee: Munro & Company, Inc., Hot Springs, AR (US)

( * ) Notice: Subject to any disclaimer, the term of this patent is extended or adjusted under 35 U.S.C. 154(b) by 616 days.

(21) Appl. No.: 11/368,725

(22) Filed: Mar. 6, 2006

(65) Prior Publication Data

US 2007/0204484 A1 Sep. 6, 2007

(51) Int. Cl.
*A43B 13/38* (2006.01)

(52) U.S. Cl. ..... 36/43; 36/88; 36/155

(58) Field of Classification Search ..... 36/43, 36/88, 93, 97, 155, 159
See application file for complete search history.

(56) References Cited

U.S. PATENT DOCUMENTS

| | | | | | |
|---|---|---|---|---|---|
| 2,139,260 | A | | 12/1938 | Cuozzo | |
| 3,412,487 | A | | 11/1968 | Diamant | |
| 3,442,031 | A | * | 5/1969 | Antell | 36/97 |
| 4,557,060 | A | | 12/1985 | Kawashima | |
| 4,813,157 | A | | 3/1989 | Boisvert | |
| 4,897,938 | A | * | 2/1990 | Otsuka | 36/88 |
| 5,068,983 | A | | 12/1991 | Marc | |
| 5,123,180 | A | * | 6/1992 | Nannig et al. | 36/43 |
| 5,138,774 | A | | 8/1992 | Sarkozi | |
| 5,175,946 | A | | 1/1993 | Tsai | |
| 5,203,096 | A | * | 4/1993 | Rosen | 36/43 |
| 5,241,762 | A | * | 9/1993 | Rosen | 36/97 |
| 5,325,614 | A | * | 7/1994 | Rosen | 36/97 |
| 5,438,768 | A | | 8/1995 | Bauerfeind | |
| 5,699,627 | A | | 12/1997 | Castro | |
| 5,768,803 | A | | 6/1998 | Levy | |
| 5,845,418 | A | * | 12/1998 | Chi | 36/3 B |
| 6,000,147 | A | | 12/1999 | Kellerman | |
| 6,425,194 | B1 | * | 7/2002 | Brie | 36/43 |
| 6,589,630 | B1 | * | 7/2003 | Crow | 428/167 |
| 6,631,568 | B2 | | 10/2003 | Howlett et al. | |
| 6,732,457 | B2 | * | 5/2004 | Gardiner | 36/155 |
| 6,792,699 | B2 | * | 9/2004 | Long et al. | 36/88 |
| 2004/0103561 | A1 | * | 6/2004 | Campbell et al. | 36/88 |
| 2004/0118017 | A1 | | 6/2004 | Dalton et al. | |
| 2006/0107552 | A1 | * | 5/2006 | Clark et al. | 36/97 |
| 2006/0107553 | A1 | * | 5/2006 | Clark et al. | 36/97 |

* cited by examiner

*Primary Examiner*—Marie Patterson
(74) *Attorney, Agent, or Firm*—Lawrence E. Laubscher, Sr.; Lawrence E. Laubscher, Jr.

(57) ABSTRACT

An adjustable fit insole system for shoes includes an insole member formed of flexible, resilient cushioning material that is removably inserted within the foot-receiving chamber of the shoe, the insole member and the shoe having corresponding heel, arch, ball and toe portions. In order to vary the internal width and girth dimensions of the ball portion of the chamber, a width adjustment pad of a desired thickness and/or hardness is removably connected with the bottom surface of the ball portion of the insole member, thereby to permit the user to customize the fit of the shoe. The top surface of the insole member is contoured to position the foot relative to the insole, and the bottom surface of the heel portion of the insole member is provided with an anti-slip stabilizing arrangement, thereby to prevent sliding movement of the insole member relative to the shoe.

5 Claims, 3 Drawing Sheets

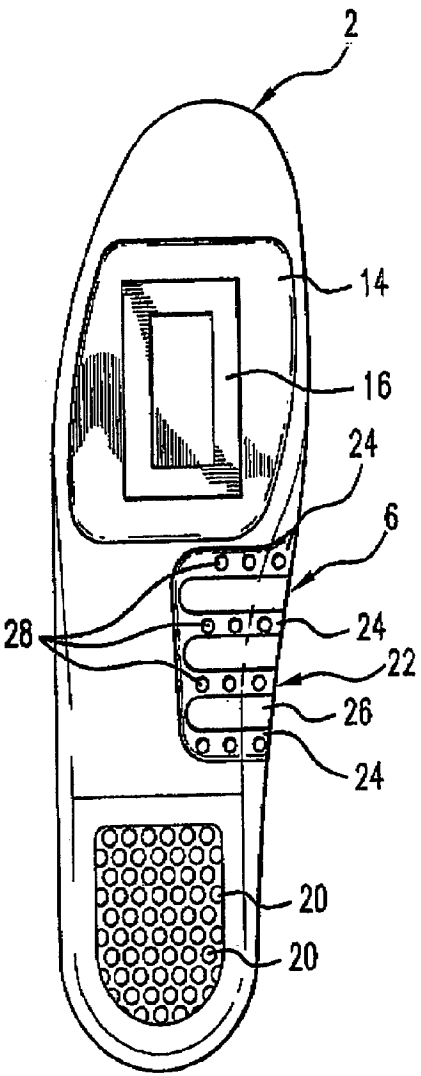
FIG.2
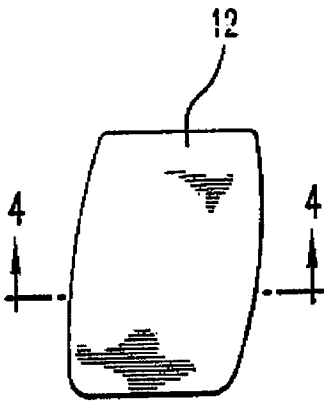
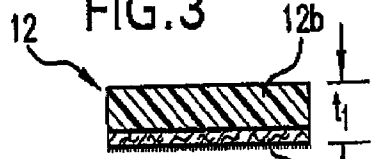
FIG.3
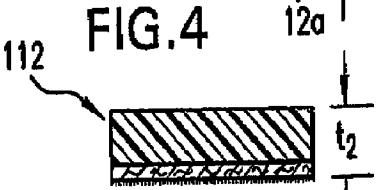
FIG.4
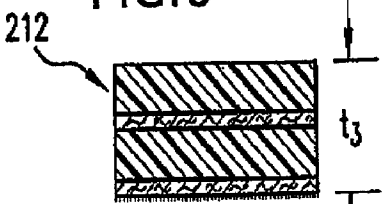
FIG.5
FIG.6
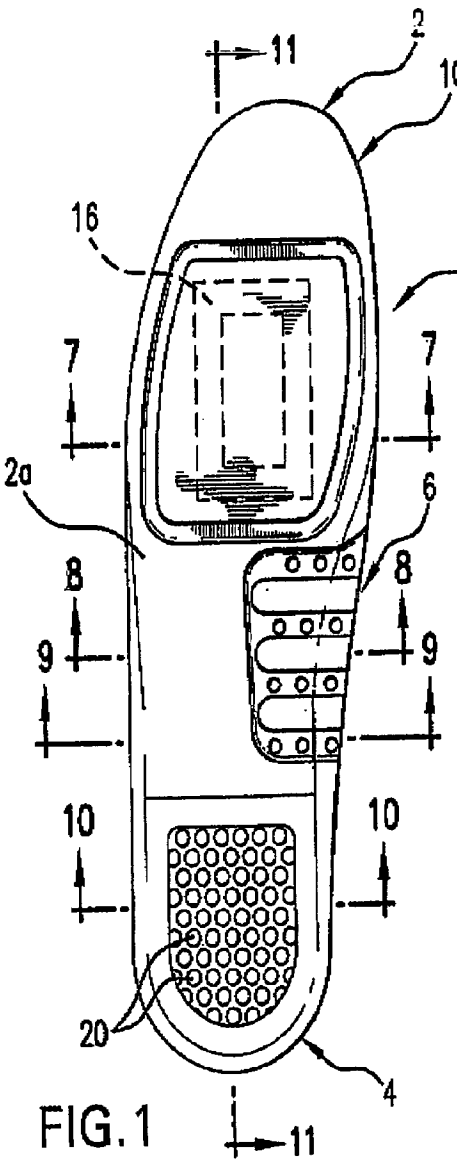
FIG.1

ADJUSTABLE FIT INSOLE SYSTEM FOR SHOES

BACKGROUND OF THE INVENTION

1. Field of the Invention

An adjustable fit insole system for shoes includes an insole member formed of flexible, resilient cushioning material that is removably inserted within the foot-receiving chamber of a shoe, the insole member and the shoe having corresponding heel, arch, ball and toe portions. In order to vary the internal width and girth dimensions of the ball portion of the chamber, a width adjustment pad of a desired thickness and/or hardness is removably connected with the bottom surface of the ball portion of the insole member, thereby to permit the user to customize the fit of the shoe.

2. Description of Related Art

Various constructions and method have been proposed in the prior art for customizing the fit of a shoe by the user. In the Antell U.S. Pat. No. 3,442,031, a shoe construction is disclosed wherein one or more removable auxiliary sole members are provided beneath the sock liner layer of a shoe for varying the width and girth dimensions of the shoe. The Boisvert et al U.S. Pat. No. 4,813,157 discloses an adjustable shoe insole system wherein removable pad layers are provided for specific adjustment of the thickness of various insole areas of the insole, particularly, the arch area, for best fit of the foot inside the shoe. The Sarkozi U.S. Pat. No. 5,138,774 teaches an insole with removable arch and heel pads in the separate areas of the heel and arch portions of the foot, thereby to provide variable height by the user, and the Bauerfeind U.S. Pat. No. 5,438,768 discloses an sole insert having a plurality of recesses for receiving replaceable elastic inserts, thereby to exercise a greater or lesser pressure at the places of the inserts. In the Dalton et al published application No. US 2004/0118017 A1, an insole having improved cushioning and anatomical centering means contains directional air ports for facilitating airflow above and below the insole. Two anatomical centering devices serve to direct the foot into proper position over cushioning pads provides in the insole. A ventilating system is also provided in the cushioned ladies shoe of the Castro U.S. Pat. No. 5,699,627.

The present invention was developed to provide an improved user-friendly removable cushioning insole construction that affords improved width adjustment means with comfort and ease of use.

SUMMARY OF THE INVENTION

Accordingly, a primary object of the invention is to provide a cushioning insole member that is adapted for removable mounting within a shoe or boot, the lower surface of the ball portion of the insole member being provided with a removable width adjusting pad for varying the effective width and girth of the shoe. The insole member is formed from polyurethane or other suitable cushioning material that demonstrates superior shock absorbency, excellent cushioning return, and extended durability. The width adjustment pad, which is removably connected with the insole by a simple hook and loop fastener arrangement, adjusts the overall girth measurement by adjusting the displacement of the cushioning material within the ball area of the shoe. The thickness dimension and/or the coefficient of hardness of the width adjusting pad may be varied to customize the shoe in accordance with the requirements and tastes of the user.

A further object of the invention is to provide the insole member with a bellows arrangement that not only produces the flow of air between the top and bottom surfaces of the insole member, but also provides flexibility adjacent the arch portion of the user's foot. The air channels and perforation holes, which are the foundation of the air flow system, create a bellows effect to force a self-generated airflow for the user's foot, thereby to produce a cooling moisture—managing and odor—reducing result.

According to another object of the invention, the upper surface of the insole member is contoured to accommodate the user's foot, and slip-resistant means are provided beneath the heel portion of the insole member, thereby to prevent displacement of the insole member within the foot-receiving chamber, and to insure positioning of the width adjusting pad beneath the ball portion of the user's foot. Integral heel knobs or nubs provide consistent fit and cooling airflow within the shank area of the shoe.

The width and girth adjustment is very easy and consumer friendly. In the case where the removable insole is initially sold together with the shoe or boot, the consumer can easily and quickly—and without lengthy instruction, tools, glue or other element—remove the insole member from the shoe, remove or substitute another width adjustment pad, and reinsert the insole member in the foot chamber of the shoe. When the insole member is sold in a package separate from the shoe, width adjusting pads of different thicknesses and/or coefficients of hardness may be provided which permit ready customization of the shoe.

The present invention provides to a broader consumer audience greater personal comfort and fit, together with lower shoe inventories. The insole member is suitable for use with all types of men's, women's and children's footwear, including dress, casual, school, work, service and military footwear. The adjustable fit system affords superior shock absorption, excellent durability, and is washable and anti-microbial.

BRIEF DESCRIPTION OF THE DRAWINGS

Other objects and advantages of the invention will become apparent from a study of the following specification, when viewed in the light of the accompanying drawing, in which:

FIG. 1 is a bottom plan view of the insole assembly of the present invention, and FIG. 2 is a corresponding view with the adjustable width pad removed;

FIG. 3 is a plan view of the adjustable width pad of FIG. 1, and

FIG. 4 is a sectional view taken along line 4-4 of FIG. 3;

FIGS. 5 and 6 are sectional views of two other embodiments of the adjustable width pad of FIGS. 3 and 4;

DETAILED DESCRIPTION OF THE INVENTION

Figure 7:
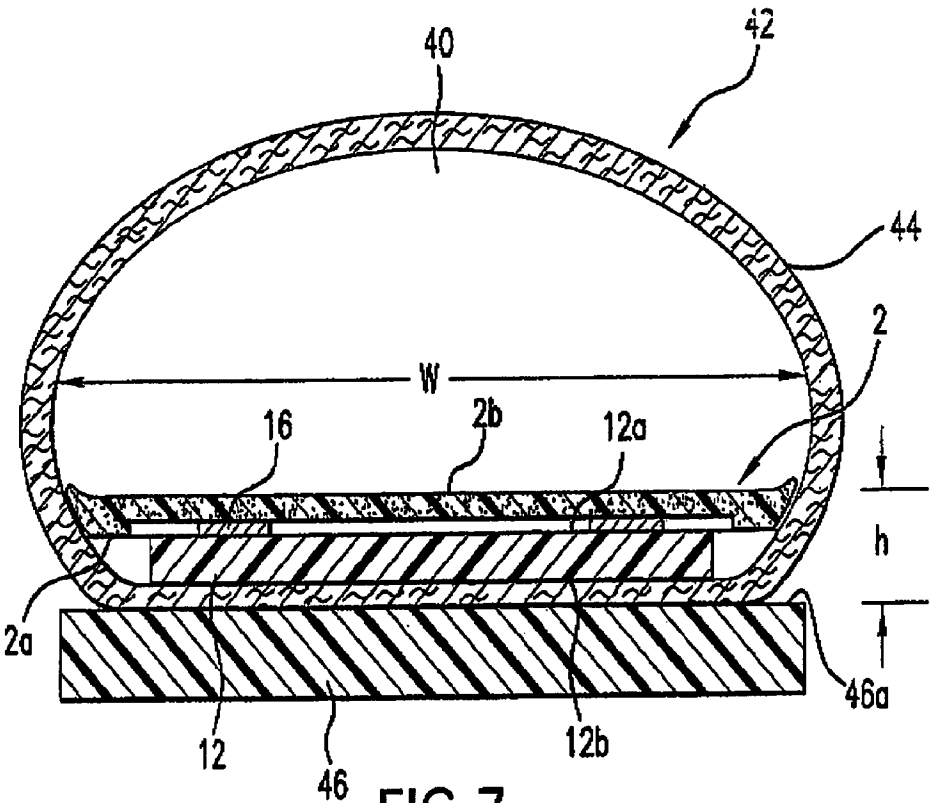
FIG. 7 is a sectional view taken along line 7-7 of FIG. 1, illustrating the insole assembly inserted within the foot chamber of a shoe.

Referring first more particularly to FIGS. 1-4, the adjustable fit insole member 2 is formed from a suitable flexible cushioning material, such as polyurethane, and includes a heel portion 4, an arch portion 6, a ball portion 8, and a toe portion 10. In accordance with a characterizing feature of the present invention, a flexible adjustable width pad 12 formed of a synthetic plastic material, such as ethyl vinyl acetate, is removably fastened to the bottom (i.e., "street") surface of the ball portion 8 of the insole member 2. To this end, the bottom surface of the insole member 2 contains a shallow recess 14 in which is secured (by a layer of suitable adhesive, for example) one fastening component 16 of conventional hook and loop fastener means. As shown in FIG. 4, the top surface 12*a* of the pad 12 is formed as the loop or weave component of the hook and loop fastener means, and the bottom or street surface of the pad 12*b* is smooth. The pad 12 has a given thickness $t_1$ such that the bottom surface 12*b* extends downwardly below the bottom surface 2*a* of the insole member, as will be explained in greater detail below.

The bottom surface of the heel portion of the insole member is provided with a plurality of integral downwardly extending nubs 20, which serve to stabilize the heel portion of the insole member relative to the heel portion of the associated shoe.

In accordance with another important feature of the invention, the arch portion 6 of the insole member is provided with ventilating means 22 that provide a flow of air between the bottom and top surfaces of the insole member adjacent the arch portion of the insole member. More particularly, the bottom surface of the insole member contains a plurality of transversely extending longitudinally spaced grooves 24 that are alternately arranged between corresponding flexure ribs 26. Perforations or apertures 28 are provided in the bottom walls of the grooves 24 and extend completely through the insole member.

Referring now to FIGS. 11-14, it will be seen that the top surface 2*b* of the insole member is contoured to define an upwardly extending corresponding curved sidewall 2*c* that extends around the heel portion 4, both the inner and outer side edges of the arch portion 6, and partially into the ball portion 8 of the insole member. This contoured sidewall 2*c* serves to position at least the heel and arch portions of the foot of the user relative to the heel portion 4 of the insole member 2. As best shown in FIGS. 1, 2, 9, and 13, the inside edge portions of the ventilating grooves 24 extend upwardly from the bottom surface of the insole member into the outer surface of the adjacent arch sidewall portion 2*c*. As will be described in greater detail below, the flexure grooves 24 and flexure ribs 26 define a bellows means for pumping air through the apertures 28, thereby to effect the flow of air between the bottom and top surfaces 2*a* and 2*b* of the insole member during walking by the user.

Figure 11:
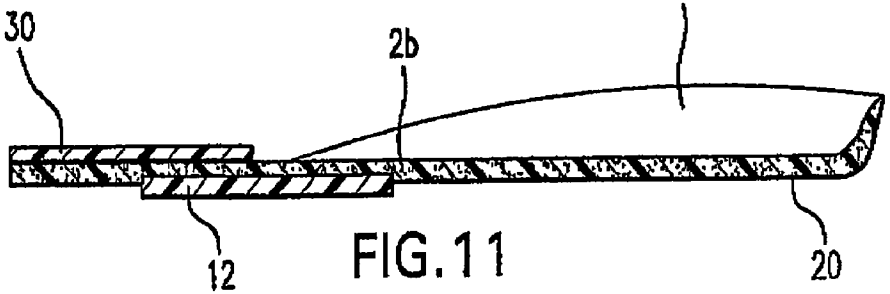
FIG. 11 is a longitudinal sectional view of the insole assembly taken along line 11-11 of FIG. 1.
Figure 12:
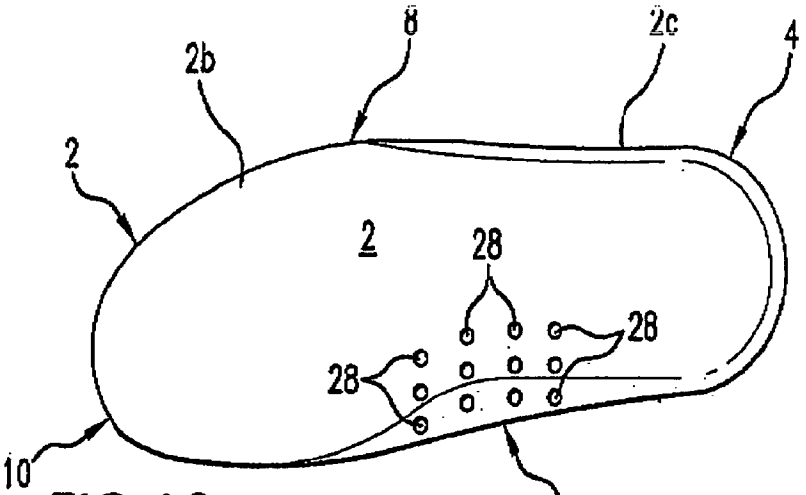
FIGS. 12-14 are top plan, left side elevation, and right side elevation views, respectively, of the insole member of FIG. 1.
Figure 13:
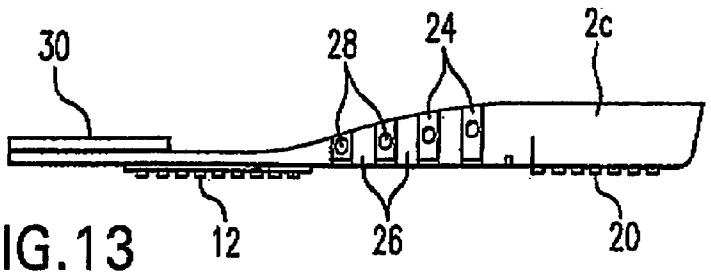
Figure 14:
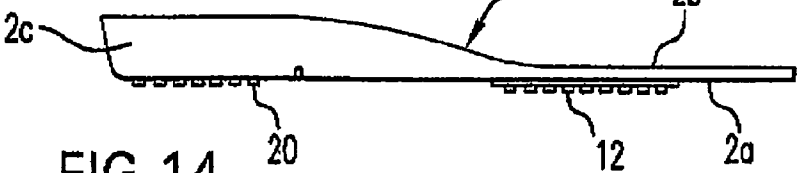
Figure 8:
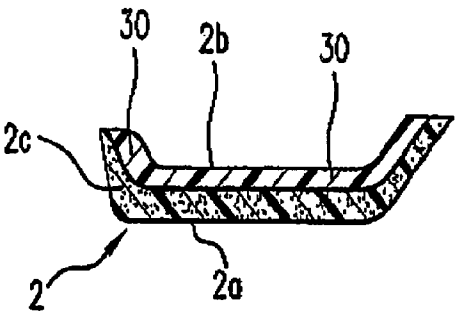
FIGS. 8-10 are transverse sectional views of the insole taken along lines 8-8, 9-9, and 10-10, respectively, of FIG. 1.
Figure 9:
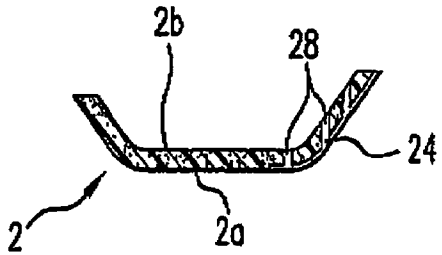
Figure 10:
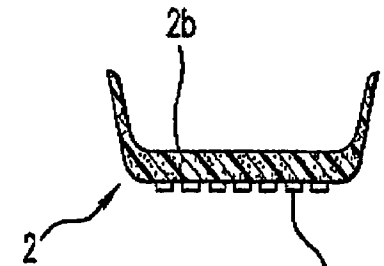

As shown in FIGS. 8, 11, and 13, the upper surface 2*b* of the insole member may be covered by a layer 30 of a brushed polyester cover material that is adhesively secured to the upper surface of the insole member.

Referring now to FIG. 7, the insole member 2 is adapted for removable insertion within the foot-receiving chamber 40 of a shoe 42. The shoe 42 includes an upper member 44 that is secured to the sole member 46. At the ball portion of the shoe, the foot-receiving chamber 40 has an internal width dimension w, and a corresponding girth dimension. The upper surface 2*b* of the insole member 2 is spaced a given distance h from the upper surface 46*a* of the cushioning insole member 46, as determined by the thickness $t_1$ of the adjustable width pad. Thus, if the adjustable width pad 12 were to be replaced by a pad 112 of greater thickness $t_2$ as shown in FIG. 5, the effective width w of the shoe (FIG. 7) would be reduced. Of course, if the pad 12 of FIG. 1 were to be removed form the insole member as shown in FIG. 2, the effective width w of the shoe would be increased. Furthermore, as shown in FIG. 6, a multi-layer adjustable width pad 212 consisting of a plurality of strippable layers may be provided having an initial relatively large thickness $t_3$, thereby to effect a given initial relatively narrow shoe width. By removing one or more of the strippable layers, a widened effective width dimension may be achieved as desired.

Furthermore, in accordance with an important advantage of the invention, the adjustable width pads may have different coefficients of hardness, whereby a softer or harder pad may be substituted for an original pad. Thus, if desired, a pad formed from a suitable gel material could be substituted for a pad formed of ethylene vinyl acetate or similar synthetic plastic material.

It is to be noted that in addition to providing a certain degree of flexibility at the inside arch portion of the insole assembly, the flexure ribs 26 and associated grooves 24 define a bellows for pumping air between the bottom and top surfaces of the insole member during normal walking operation by the user. This has the advantage of circulating air within the foot chamber of the shoe, particularly adjacent the inside arch region of the shoe chamber.

While in accordance with the provisions of the Patent Statutes the preferred forms and embodiments of the invention have been illustrated and described, it will be apparent to those skilled in the art that changes may be made without deviating from the invention described above.

What is claimed is:

1. A shoe having an adjustable fit insole system, comprising:

(a) a sole member (46) having upper and lower surfaces;

(b) an upper member (44) secured to said sole member to define a shoe having a foot-receiving chamber (40);

(c) a unitary insole member (2) removably inserted within said foot-receiving chamber, said sole member and said insole member having corresponding heel, arch, ball and toe portions, the portion of said chamber adjacent said insole ball portion having given internal width (w) and girth dimensions, said insole member being formed of a resilient cushioning material and including top and bottom surfaces, toe and heel edge portions, and inside and outside arch side edge portions;

(d) slip-resistant stabilizing means (20) arranged on the bottom surface of said insole member heel portion, said stabilizing means cooperating with the adjacent bottom surface of said foot-receiving chamber to prevent sliding displacement of said insole member heel portion relative to said shoe;

(e) contour means defined on the top surface of said insole member for positioning at least the heel and arch portions of the user's foot relative to said insole member, said contour means including a pair of curved side walls (2*c*) that extend upwardly from at least said heel and arch inside and outside side edge portions;

(f) means for varying the effective width and girth of said chamber ball portion, comprising;

(1) a width adjustment pad (12) arranged beneath the bottom surface of said insole member ball portion, and (2) releasable connecting means (12*a*, 16) connecting said width adjustment pad with said insole member, said width adjustment pad having such a thickness (t) as to cause the bottom surface of said pad to protrude downwardly for engagement with the adjacent bottom surface of said chamber; and (g) bellows means operable upon walking by the shoe's user to pump air between the outer and inner of said insole member inside arch portion, said bellows means comprising:

(1) a plurality of longitudinally-spaced transversely-extending continuous grooves (24) contained in the outer surface of said sole member inside arch portion, each of said grooves including a first portion extending horizontally transversely across the bottom surface of said insole member, and a second portion extending vertically upwardly within the outer surface of the adjacent inner arch side wall portion, thereby to define between said grooves a plurality of flexure ribs (26), respectively;

(2) said groove first and second portions having bottom walls containing a plurality of perforations (28) extending completely through said insole member, thereby to transmit air between the outer and inner surfaces of said insole member inside arch portion.

2. A shoe as defined in claim 1, wherein said releasable connecting means comprises hook and loop fastener means including:

(a) a first fastening strip component (16) secured within a recess (14) contained in the bottom surface of said insole member; and (b) a corresponding second fastening layer component (12*a*) fastened to the top surface of said width adjustment pad.

3. A shoe as defined in claim 2, and further including a plurality of said width adjustment pads having different coefficients of hardness, said pads being selectively connected with said insole member to customize the shoe as desired by the user.

4. A shoe as defined in claim 2, and further including a plurality of said width adjustment pads having different thicknesses, said pads being selectively connected with said insole member to customize the effective width and girth dimensions of the shoe as desired by the user.

5. An adjustable fit insole system as defined in claim 1, wherein said slip-resistant stabilizing means comprises a plurality of integral nubs (20) that extend downwardly from the bottom surface of said insole member heel portion.

* * * * *